United States Patent [19]

Amodeo

[11] 4,042,932

[45] Aug. 16, 1977

[54] ANTENNA ANCHOR FOR AUTOMOBILES

[76] Inventor: Guy Thomas Amodeo, 202 Jefferson St., East Islip, N.Y. 11730

[21] Appl. No.: 704,918

[22] Filed: July 13, 1976

[51] Int. Cl.[2] ..... H01E 1/32

[52] U.S. Cl. ..... 343/715

[58] Field of Search ..... 343/715, 713, 700, 749, 343/750, 900, 903, 889, 887; 292/264

[56] References Cited

U.S. PATENT DOCUMENTS

| | | | |
|---|---|---|---|
| 2,368,174 | 1/1945 | Thomas et al. | 343/715 |
| 2,811,330 | 10/1957 | Demunter | 343/715 |
| 3,011,818 | 12/1951 | Matthiessen | 292/264 |

*Primary Examiner*—Alfred E. Smith
*Assistant Examiner*—David K. Moore
*Attorney, Agent, or Firm*—Howard Myles Schwinger

[57] ABSTRACT

This invention relates to an anchor for an automobile whip antenna which consists of a non-rigid linear attachment adapted to be extended beyond the tip of the antenna and by means of which the upper part of the antenna can be pulled downwardly toward the vehicle intended to carry it and the antenna held in this lowered position when the car door is closed upon the extension.

2 Claims, 2 Drawing Figures

ANTENNA ANCHOR FOR AUTOMOBILES

This invention relates to radio antennas and more particularly to the whip antenna used on automobiles having civilian band radios.

Such an antenna is usually exteriorly mounted on the rear of the car and extends many feet above its top wall. The tall antenna can, at times, present a problem because of its height. It can readily be damaged by low hanging structures under which the car passes such as trees, ceilings and apparatus such as found in an automatic car washing assemblage.

When the relatively expensive antenna makes contact with such an object, the antenna can be permanently bent and even broken thus marring the appearance of the antenna and the car carrying it and possibly impairing the electrical efficiency of the antenna itself.

Heretofore proposals have been made for clipping the antenna directly to the roof of the car but, for one reason or other, the clips do not hold.

It is therefore amongst the primary objects of the present invention to provide an inexpensive, quick and simple means for anchoring the antenna and keeping it out of the way when the vehicle carrying it is passing under low hanging structures.

THE DRAWING

FIG. 1 is a perspective view showing the upper end of a whip antenna attached to the device of the present invention; and FIG. 2 is a perspective view showing the antenna anchor of the present invention in actual use.

DETAILED DESCRIPTION OF THE DRAWING

Figure 1:
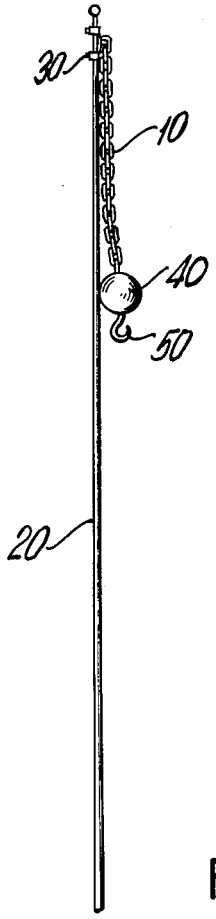

An embodiment of the antenna anchor of the present invention is shown in the drawing consisting of a length of flat chain 10 attached to antenna 20 by means of clamp 30 which, in this particular embodiment of the invention, is carried by the chain.

The clamp consists of a sleeve into which the tip of the antenna is inserted and is provided with bolts which are tightened to lock the sleeve to the antenna.

The other end of the chain is provided with a cushioned abutment 40, in this case of molded plastic composition. The abutment should be relatively soft and resilient for reasons hereinafter appearing. The abutment may also carry a hook 50.

Figure 2:
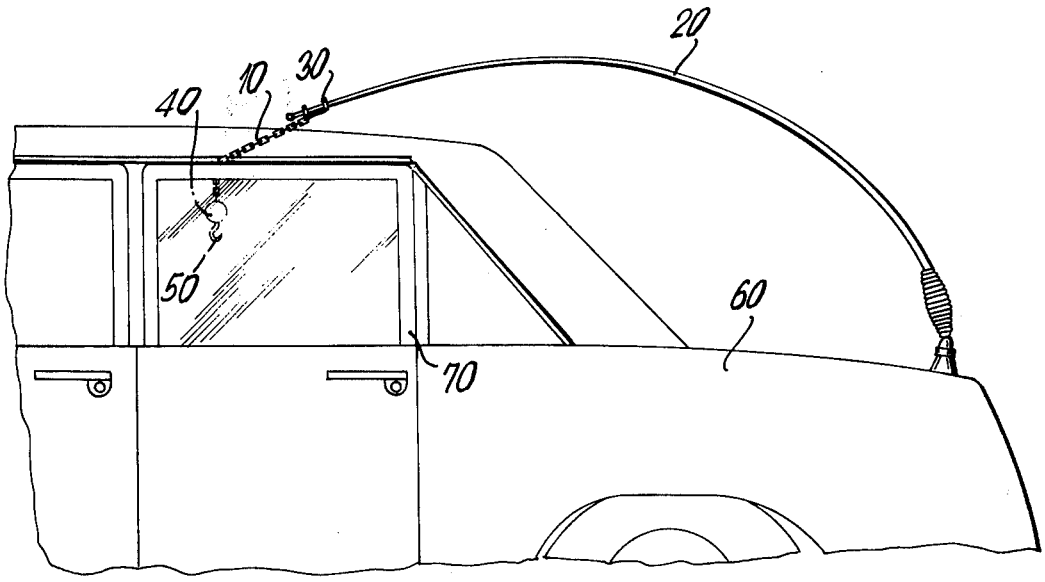

In FIG. 2 the anchor is shown in actual use on an automobile 60. It can be seen that the normally upright antenna has been lowered, most readily by drawing upon the anchor itself, and car door 70 has been closed upon the anchor to firmly clamp the antenna in this lowered position. In this manner the antenna may be kept clear of low hanging objects which may present themselves above the car.

The accidental release of the antenna is prevented by the clamping action of the door upon the chain and further by abutment 40. If the chain should accidentally slip because the door is not closed tightly, etc, or something catches it and pulls it, abutment 40 will prevent complete withdrawal from the car door. The abutment is cushioned so it will not mar or damage the interior of the car. The flat chain will not damage the door or window because the edge of the door frame is normally lined with a sealing gasket which is soft and resilient.

Hook 50 is provided for fastening the antenna exteriorly of the vehicle, such as to the rain gutter of the roof, thus the device provides two options for the fastening of the antenna. Both the hook and a terminal chain link may be molded into abutment 40 when the abutment is formed.

Needless to say, the collapsible nature of the anchor makes it ideal for the purpose for which it is intended. It will yield under the clamping force of the door without damage thereto and can be used repeatedly and reliably in this connection.

I claim:

1. An anchor for a whip antenna comprising a flexible line means for connecting said line to an end portion of a whip antenna for automobiles and arranged to bow the antenna to a lowered position when downwardly drawn, a cushioned abutment mounted at the lead end of the flexible line and adapted to hold the antenna in a lowered position when the flexible line is clamped by a vehicle door, the flexible line extending exteriorly of the vehicle over the door gasket when the antenna is so anchored.

2. An anchor in accordance with claim 1 wherein the cushioned abutment is spherical.

* * * * *